US011814887B2

(12) United States Patent
Fisher et al.

(10) Patent No.: US 11,814,887 B2
(45) Date of Patent: Nov. 14, 2023

(54) CONCEALABLE HINGE

(71) Applicant: INNOVATIONS BY FISHER, LLC, Maple Grove, MN (US)

(72) Inventors: Tim Fisher, Maple Grove, MN (US); Jon Fisher, Maple Grove, MN (US)

(73) Assignee: INNOVATIONS BY FISHER, LLC, Maple Grove, MN (US)

( * ) Notice: Subject to any disclaimer, the term of this patent is extended or adjusted under 35 U.S.C. 154(b) by 454 days.

(21) Appl. No.: 16/723,289

(22) Filed: Dec. 20, 2019

(65) Prior Publication Data

US 2021/0189779 A1 Jun. 24, 2021

(51) Int. Cl.
*E05D 3/06* (2006.01)

(52) U.S. Cl.
CPC ..... *E05D 3/06* (2013.01); *E05Y 2900/60* (2013.01)

(58) Field of Classification Search
CPC ..... E05D 3/06
See application file for complete search history.

(56) References Cited

U.S. PATENT DOCUMENTS 2,073,689 A * 3/1937 Gotzinger ..... E05D 3/18 16/358
4,704,970 A 11/1987 Sanderson et al.
5,075,928 A * 12/1991 Bobrowski ..... E05D 5/06 16/273
5,282,293 A * 2/1994 Pedoeem ..... E05D 3/12 16/342
5,544,595 A * 8/1996 Stephenson, III .. E05D 11/0018 109/74
6,257,154 B1 * 7/2001 Kasper ..... E05B 9/086 109/73
6,905,101 B1 * 6/2005 Dittmer ..... F16M 11/10 248/125.7
7,866,621 B1 * 1/2011 Walters ..... F16M 13/02 248/421
7,987,558 B2 8/2011 Beckmann et al.
8,296,906 B2 * 10/2012 Wisniewski ..... E05D 3/14 16/370
8,477,486 B2 * 7/2013 Yang ..... G06F 1/1624 361/679.27

(Continued)

FOREIGN PATENT DOCUMENTS

CA 2795929 C 5/2018
CN 201944511 U 8/2011

(Continued)

*Primary Examiner* — Jason W San
(74) *Attorney, Agent, or Firm* — Westman, Champlin & Koehler, P.A.; Amanda M. Prose

(57) ABSTRACT

A hinge for pivotally securing a frame substantially flush to a mounting surface, the hinge comprising a plurality of leaves and a plurality of articulation points wherein each leaf is connected to two articulation points and movement of at least one leaf connected to each articulation point occurs substantially simultaneously. With four leaves and four articulation points the hinge is configured for fluid movement as the articulation points are utilized or activated concurrently to pivot the frame about the hinge and with respect to a mounting surface. A pair of hinges wherein one hinge may be a mirror image of the other can be used to mount the frame to the mounting surface.

16 Claims, 7 Drawing Sheets

(56) References Cited

U.S. PATENT DOCUMENTS

| | | | | |
|---|---|---|---|---|
| 8,656,559 | B2 * | 2/2014 | Hung | E05D 3/16 16/369 |
| 8,684,325 | B1 | 4/2014 | Beshara | |
| 8,833,876 | B2 | 9/2014 | Lee | |
| 8,967,569 | B2 * | 3/2015 | Hsu | F16M 11/10 248/284.1 |
| 9,376,846 | B2 * | 6/2016 | Aral | E05D 3/06 |
| 2003/0046794 | A1 * | 3/2003 | Muir | E05D 15/44 16/366 |
| 2005/0223524 | A1 * | 10/2005 | Muir | E05D 15/30 16/366 |
| 2008/0297012 | A1 | 12/2008 | Cooper | |
| 2009/0050763 | A1 * | 2/2009 | Dittmer | F16M 11/24 248/284.1 |
| 2009/0065670 | A1 * | 3/2009 | Wu | F16M 13/02 248/284.1 |
| 2010/0149736 | A1 * | 6/2010 | Dittmer | F16M 13/022 361/679.01 |
| 2011/0019344 | A1 * | 1/2011 | Russell | F16M 11/2092 361/679.01 |
| 2015/0250315 | A1 * | 9/2015 | Gross | H05K 5/0017 361/679.01 |
| 2015/0286286 | A1 * | 10/2015 | Jiang | G06F 3/0221 16/320 |
| 2016/0201718 | A1 * | 7/2016 | Mak | F16M 11/2007 16/366 |

FOREIGN PATENT DOCUMENTS

| | | | |
|---|---|---|---|
| DE | 102010019548 | A1 | 11/2011 |
| EP | 1726760 | A2 | 11/2006 |
| ES | 2382006 | T3 | 6/2012 |
| JP | 2009114709 | A | 5/2009 |
| JP | 5118387 | B2 | 1/2013 |
| KR | 10-2004-0063652 | A | 7/2004 |

* cited by examiner

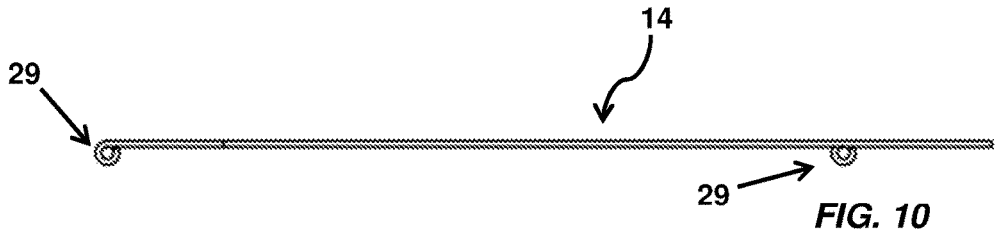
FIG. 10
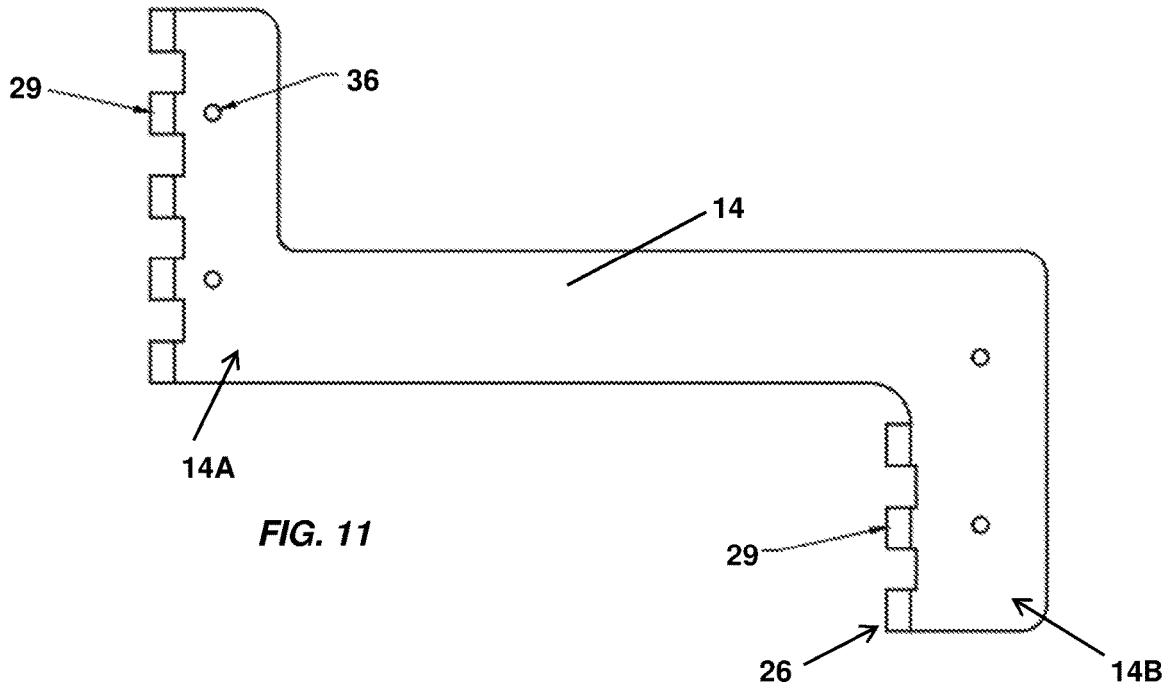
FIG. 11
FIG. 12
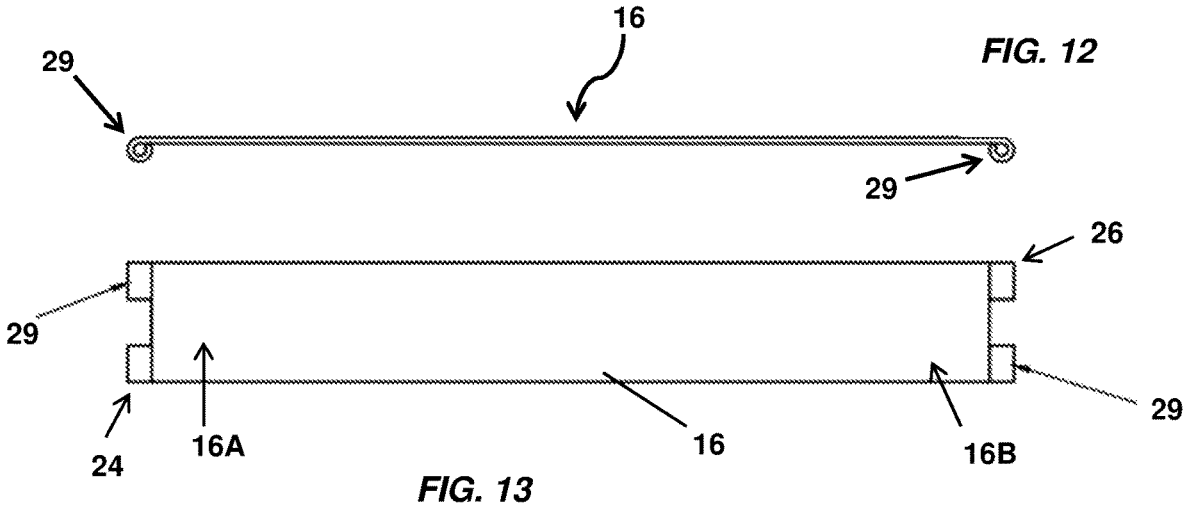
FIG. 13

CONCEALABLE HINGE

BACKGROUND

Hinges can be used for securing a frame to a surface, such as a picture frame to a wall surface. Such mountings enable the frame to cover an in-wall object or structure such as a safe and allow easy access. The hinges and assemblies are bulky. These bulky hinges make it visually obvious the frame is covering an object. This can not only be unsightly, but more importantly, an indicator to an intruder that valuable items may be hidden behind the frame.

To conceal the hinge and allow the picture frame to lay flush against the wall in the manner of a standard frame mounting, the hinges are mounted in a recessed area in the wall. In other embodiments, the frame of the wall is altered to have a recessed area or thicker frame to cover the hinge itself. However, in these arrangements, the pivotal range of the frame is limited and can be restricted to less than 90 degrees.

Other prior art methods of mounting a frame to a wall for covering an in-wall structure include sliding racks where the frame is flush against the wall but is mounted for sliding to one side to reveal the in-wall structure. This requires a large clearance on at least one side of the frame and is not practical in many spaces.

SUMMARY

An aspect of the present disclosure relates to a hinge having a plurality of leaves and a plurality of articulation points, wherein each leaf is connected to two different articulation points.

Each of the plurality of leaves is substantially flat.

A first leaf is provided with one or more apertures for securing the hinge to a mounting surface. A second leaf is provided with one or more apertures for securing an object to the hinge to pivotally secure the object to the mounting surface.

In a first position the hinge is substantially flat having a substantially consistent thickness of less than about 3/16 inch.

The hinge has four leaves and four articulation points. Each articulation point is a joint between two leaves which forms a knuckle for a pivot point. Each of the plurality of articulation points is actuated concurrently.

Another aspect of the present disclosure relates to a mounting for pivotally securing a frame substantially flush to a surface. The mounting includes a first hinge having a plurality of leaves and a plurality of articulation points wherein each leaf is connected to two articulation points; and a second hinge having a plurality of leaves and a plurality of articulation points wherein each leaf is connected to two articular points and wherein the second hinge is a mirror image of the first hinge.

The first and second hinge each have a thickness of about 3/16 inch or less for providing a mounting position wherein a space of about 3/16 inch or less is provided between the frame and the surface.

The first and second hinge each comprise a plurality of mounting apertures for receiving a fastener therethrough wherein mounting apertures are provided in two leaves of the plurality of leaves of each of the first and second hinge.

The plurality of leaves are comprised of metal, plastic, or combinations thereof.

Yet another aspect of the present disclosure relates to a hinge for pivotally securing a frame substantially flush to a mounting surface, where the hinge has a plurality of leaves and a plurality of articulation points wherein each leaf is connected to two articulation points. Movement of at least one leaf connected to each articulation point occurs substantially simultaneously.

The hinge has four leaves and four articulation points wherein one leaf is mounted to the mounting surface and the three remaining leaves are pivoted concurrently with one leaf pivoting about two different articulation points concurrently.

The hinge is configured for mounting a first side of the frame to the mounting surface such that the frame can be pivoted away from the mounting surface about the first side by way of opening a second opposing side of the frame.

In a first position the hinge is a substantially flat hinge. In a second position the hinge has three sides to form an overall triangular shape. Two leaves form one side of the hinge in the second position. In the second position a first side of the hinge is secured to the mounting surface and a second side of the hinge supports the frame.

BRIEF DESCRIPTION OF THE DRAWINGS

FIG. 10 is top view of a second leaf of the hinge.

FIG. 11 is a front view of the second leaf.

FIG. 12 is top view of a third leaf of the hinge.

FIG. 13 is a front view of the third leaf.

DETAILED DESCRIPTION

Figure 1:
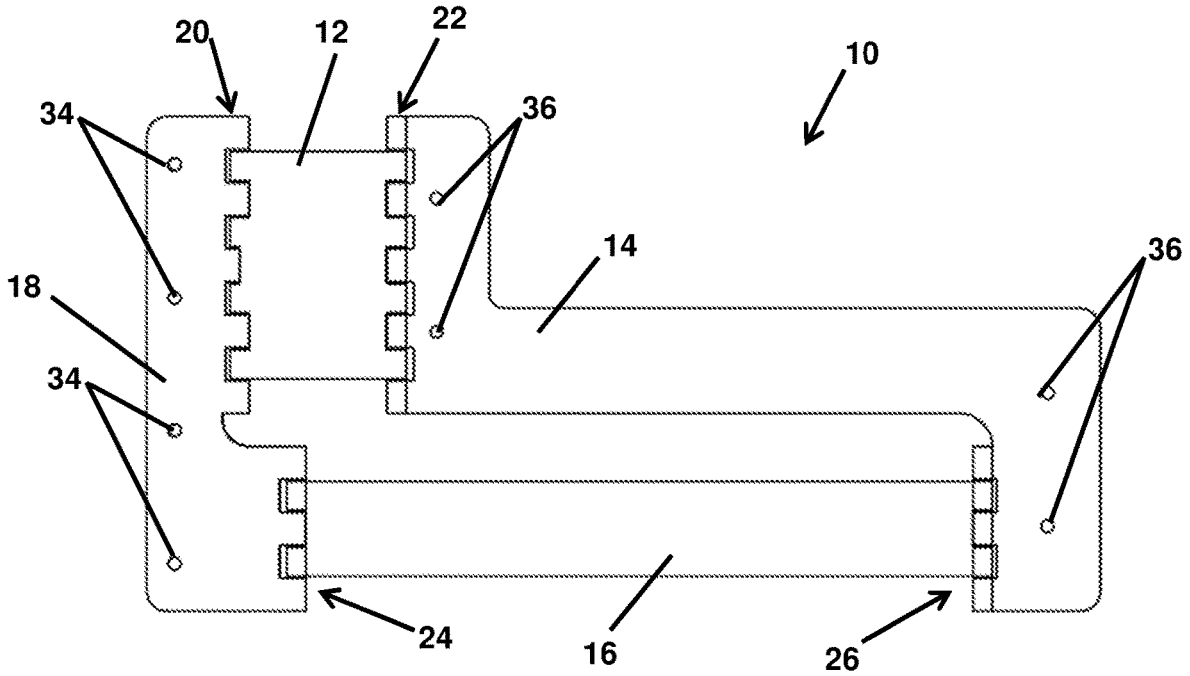
FIG. 1 is a front view of a hinge in a mounting position.
Figure 2:
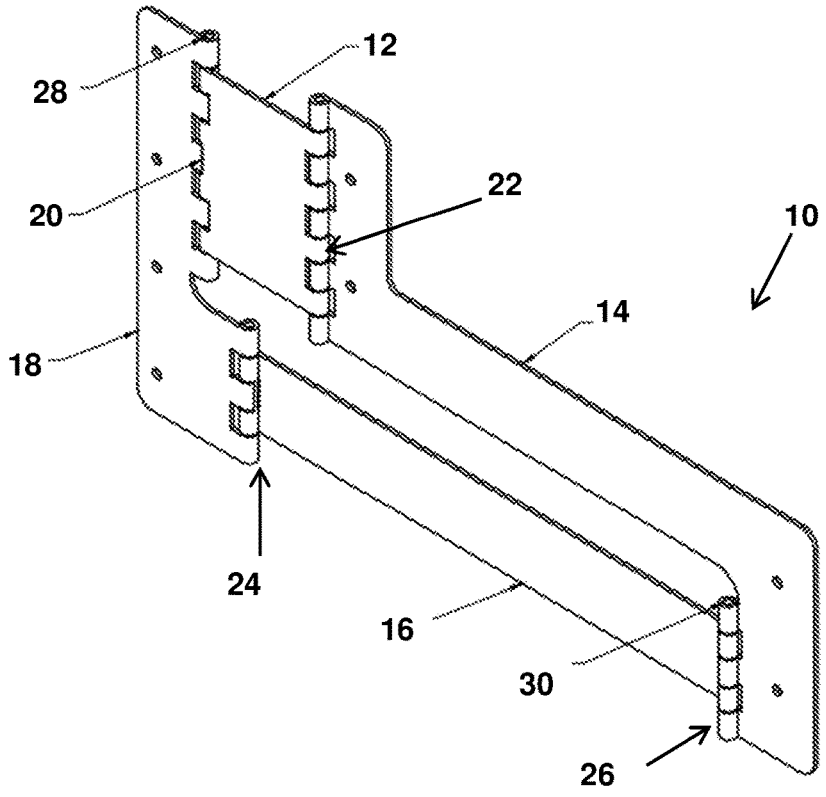
FIG. 2 is a side perspective view of the hinge in the mounting position.

A hinge for pivotally mounting an object to a surface is disclosed herein. The hinge allows for the object to be mounted substantially flush against the surface as the hinge, in a mounting position, is substantially flat and thin. The hinge has multiple articulation points, referred to herein as "joints" or "knuckles" for providing multiple articulation points or pivot points such that the object can be pivoted away from the mounting surface by use of one or more hinges described herein. In one embodiment a frame such as a picture frame can be mounted with one or more hinges to a wall to cover an in-wall device, such as a safe. The picture frame then is pivoted about the hinges to open in the manner of a door to expose the safe. The hinge or hinges are sufficiently low in profile in the mounting position such that the picture frame is nearly flush or otherwise substantially flat against the wall as the hinges provide a mounting mechanism that is concealed by the picture frame in the same manner other picture frame hanging or mounting equipment is fully hidden behind the picture frame without substantially spacing the frame away from the wall. The hinges do not have a protruding or visible joint, or knuckle, in the manner of ordinary or standard door hinges when used to pivotally mount an object to wall.

The hinge described herein is mountable on a pre-existing wall or mounting surface and does not require alteration of the surface or the frame. That is, the hinge or a pair of hinges can be used in the manner of ordinary hanging kits, meaning that no recesses in the wall or alteration of the frame construction are required to mount the frame to the surface in a manner substantially flush against the wall surface. Fasteners such as nails or screws can be used to secure one side of the hinge to the mounting surface and to secure a second side of the hinge to the frame.

While illustrative examples used herein may refer to a picture frame or mirror mounting to a flat surface such as a vertical section of wall, the use of the hinge described herein is not so limited. Any number of objects may be pivotally mounted to any number of surfaces in any orientation. That is, the hinge may be used to conceal storage openings in floors or walls with items appearing to be floor boards, other decorative items flat or flush to the surface, or mirrors, art or other framed items.

One or more hinges may be used to mounting a frame or mirror to a flat surface. When two or more hinges are used for mounting, the knuckles of each hinge may be inline or aligned along a same axis, for example, on a same side of the frame or mirror and in the same plane so as to enable smooth use and pivoting of the frame or frame with respect to the mounting surface and to prevent binding.

A hinge 10 for pivotally mounting an object to a surface is illustrated in FIGS. 1-19. The hinge comprises a plurality of articulation points 20, 22, 24, and 26 and a plurality of leaves 12, 14, 16, and 18. The leaves 12, 14, 16, and 18 are connected to adjacent leaves 12, 14, 16, or 18 via the articulation points knuckles in a manner that provides a multi articulation point hinge. In the embodiment illustrated there are four leaves 12, 14, 16, and 18 which are connected by four articulation points 20, 22, 24, and 26. The leaves 12, 14, 16, and 18 are connected to an articulation point on opposing ends of the leaf 12, 14, 16, and 18 such that each leaf 12, 14, 16, and 18 has two different joints connected thereto.

Figure 3:
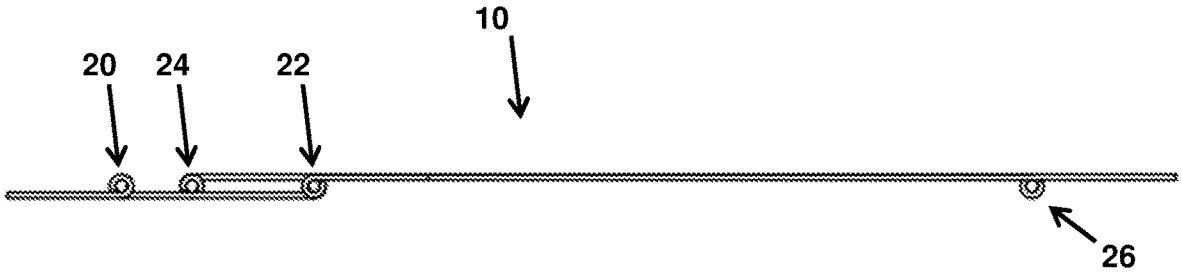
FIG. 3 is top view of the hinge in the mounting position.
Figure 4:
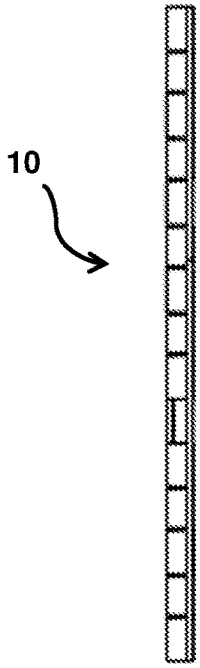
FIG. 4 is side view of the hinge in the mounting position.

In a first position, a mounting position, the hinge 10 is substantially flat such that a thickness of the hinge 10 is only as great as a thickness of a thickest leaf or articulation point. That is, in the mounting position, as illustrated in FIGS. 1-4 for example, the leaves 12, 14, 16, and 18 and the articulation points 20, 22, 24, and 26 are substantially in a same plane, providing a flat hinge 10. This allows a frame secured to the hinge to be substantially flush against a mounting surface to which the hinge is also secured. Moreover, the thickness of the hinge, as illustrated in FIGS. 3 and 4 may be as small as about 3/16 inch or less.

In the embodiment illustrated, one leaf is a surface mounting leaf 14 meaning the leaf 14 is provided with one or more apertures 34 for receiving a fastener there through. Examples of fasteners may include but are not limited to nails or screws. The leaf 14 is secured to a mounting surface or wall.

A second leaf is a frame supporting leaf 18 that is also provided with one or more apertures 36 for receiving a fastener there through. Examples of fasteners may include but are not limited to nails or screws. The frame is secured to leaf 18 to allow for pivoting of the frame attached thereto when the hinge is used.

Figure 5:
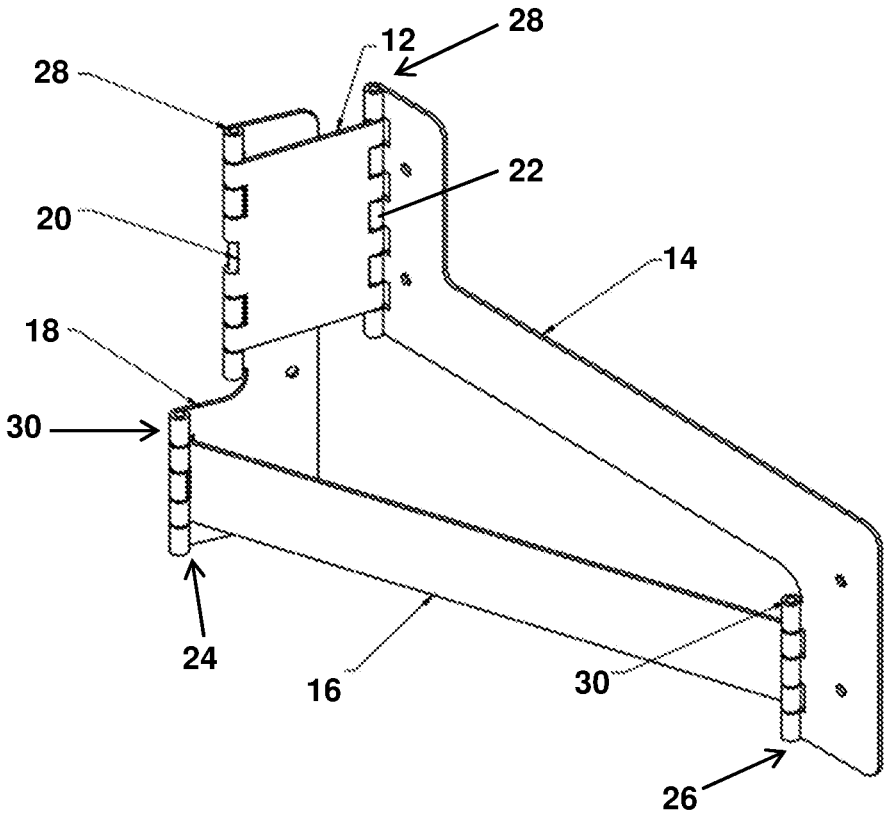
FIG. 5 is a side perspective view of the hinge in a use position.
Figure 6:
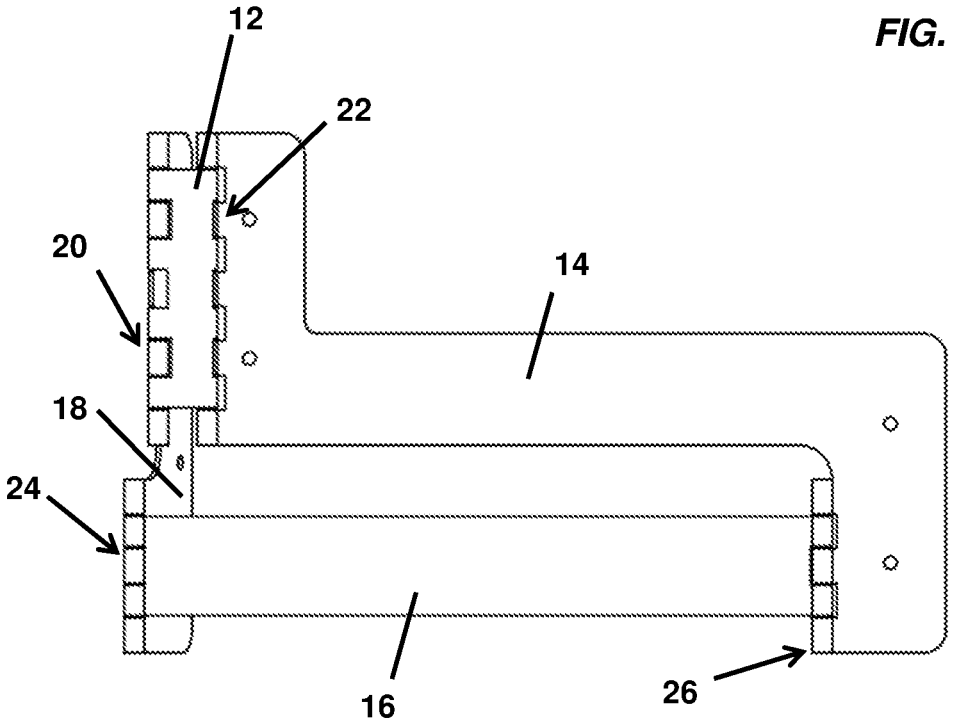
FIG. 6 is front view of the hinge in the use position.
Figure 7:
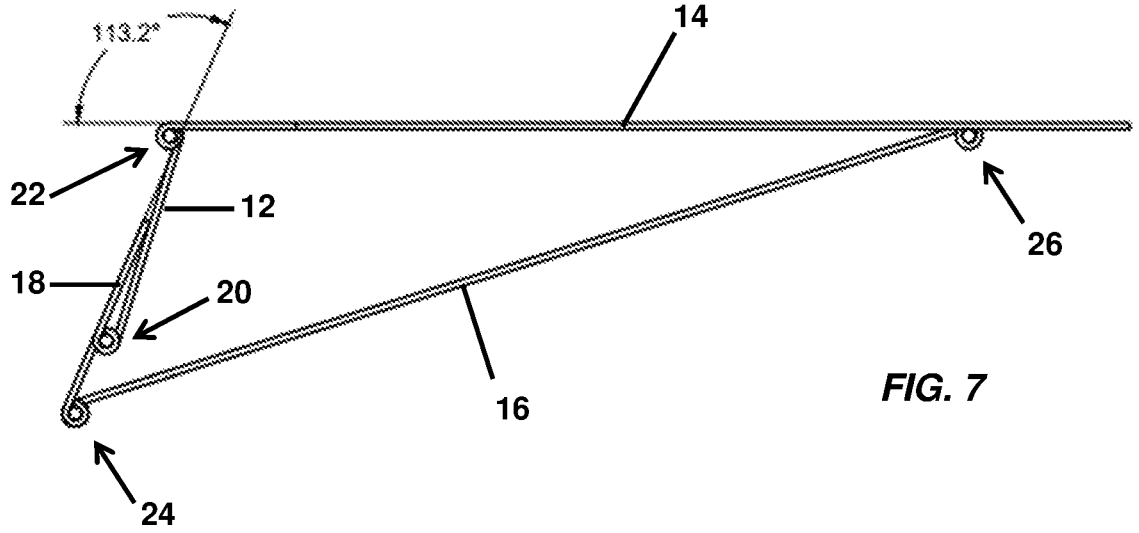
FIG. 7 is a top view of the hinge in the use position.

In a second position, an open position, as illustrated in FIGS. 5-7, the articulation points 20, 22, 24, and 26 cooperate to allow the displacement of leaves 12, 16, and 18 with respect to the mounting leaf 14 which is secured to the mounting surface. When in the second, open, the hinge 10 may have an overall "V" shape such that the hinge 10 opens at a first end by way of the first articulation point 26 and at a second opposing end by way of articulation points 20, 22, and 24.

The articulation points 20, 22, 24, and 26 provide one or more positions of the leaves 12, 14, 16, and 18 of the hinge 10 between the mounting and open positions.

In further detail, as illustrated in FIG. 7, the range of motion of the leaves 12, 14, 16, and 18 is enabled by a hinge 10 arranged in one embodiment as illustrated in the figures. Each articulation point 20, 22, 24, and 26 illustrated is a joint that may be formed by interconnecting hollow portions on each leaf where a pin is slid therethrough. As used throughout this disclosure, the term knuckle refers to the articulation point and comprises hollow portions from each leaf which forms that respective articulation and having a pin for sliding there though to pivotally connect the respective leaves.

In the embodiment illustrated, a first end 14A of leaf 14 is pivotally connected to a second end 12A of leaf 12 via knuckle 22. A second, opposing end 14B of leaf 14 is pivotally connected to a second end 16B of leaf 16 at knuckle 26. A first opposing end 16A of leaf 16 is then pivotally connected at knuckle 24 to a second end 18B of leaf 18. A first opposing end 18A of leaf 18 is then pivotally connected at knuckle 20 to a first end 12B of leaf 12. That is, each leaf 12, 14, 16, and 18 is connected via two different joints or knuckles 20, 22, 24, and 26 to two different leafs 12, 14, 16, and 18.

The knuckles 20, 22, 24, and 26 are formed by way of corresponding and/or alternating hollow portions 29 on ends of adjacent leaves 12, 14, 16, and 18 wherein a pin 28 or 30 is received in the aligned hollow portions 29 to provide pivoting joints for the hinge 10.

In the embodiment illustrated, the knuckles 20, 22, 24, and 26 are engaged concurrently such that movement of the leaves 12, 16, and 18 occurs concurrently when the leaf 14 is mounted to the mounting surface. Thus, when a frame is attached to the frame supporting leaf 18 and the frame is moved, the hinge 10 provides a fluid movement as the leaves are moved together to pivot the frame away from the mounting surface with which it was covering.

In one embodiment, a frame can be mounted by one hinge or a pair of hinges positioned on one side of the frame to provide a pivot point on that side of the frame. The frame can then be "opened" in the manner of a door for example, by moving a side of the frame opposite the side behind which the hinges secure the frame to the mounting surface. Where a pair of hinges is used to mount the frame to the mounting surface, the two hinges provided may be mirror images of one another to provide for upper and lower mounting to a side opening frame, or to provide left and right mountings to a bottom or top opening frame.

Each of the leaves 12, 14, 16 and 18 may be a plate or plates comprised of a metal or a hard plastic material, or combinations thereof. The plates may be substantially flat plates. The articulation points 20, 22, 24, and 26 may provide the overall thickness to the hinge in a mounting position as illustrated in FIGS. 3 and 4 and thus the knuckles and hinge may have a thickness of about 4.76 mm or less (about 3/16 inch or less). However, larger or smaller dimensions for any one or all of the components of the hinge 10 are contemplated as the hinge 10 may be provided in various sizes for pivotally securing larger or smaller objects to any surface.

Figure 8:
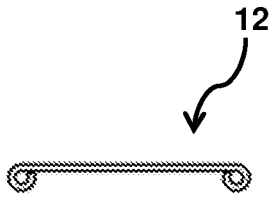
FIG. 8 is a top view of a first leaf of the hinge.
Figure 9:
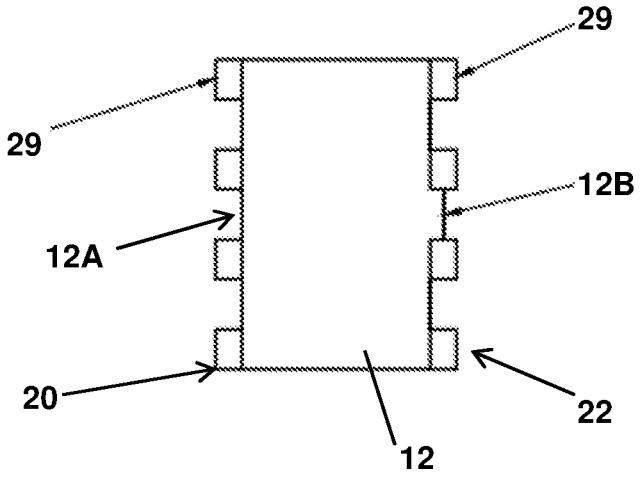
FIG. 9 is a back view of the first leaf.

Referring to FIGS. 8-9, the first leaf 12 may be square or rectangular in shape and have knuckle portions 29 along lengths 12A and 12B of two opposing sides of the leaf 12.

Referring to FIGS. 10-11, the second leaf 14 is a mounting leaf 14 for securing to a mounting surface. The second leaf 14 has a first end 14A and a second end 14B where these ends extend in opposite directions from a main body 14. For example, the first end 14A extends upwardly away from the length of the main body 14 and the second end 14B extends downwardly away from the main body 14 where the second leaf 14 may be a monolithic or an integral structure. The ends each support a knuckle portion 29 on one side length. While the terms "upwardly" and "downwardly" are used, such use is for purposes of illustration and such spatial orientation terms are merely for description, and are not limiting. The leaf 14 may also have one or more apertures 36 for receiving a fastener for securing the hinge 10 to a mounting surface.

Referring to FIGS. 12-13, a third leaf 16 is rectangular in shape, having a length that is greater than a width of the leaf 16. Opposing ends 16A and 16B of the length terminate with connectable knuckle portions 29 coextending along the height thereof.

Figure 14:
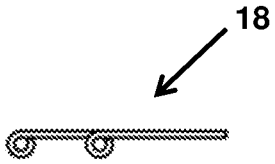
FIG. 14 is a top view of a fourth leaf of the hinge.
Figure 15:
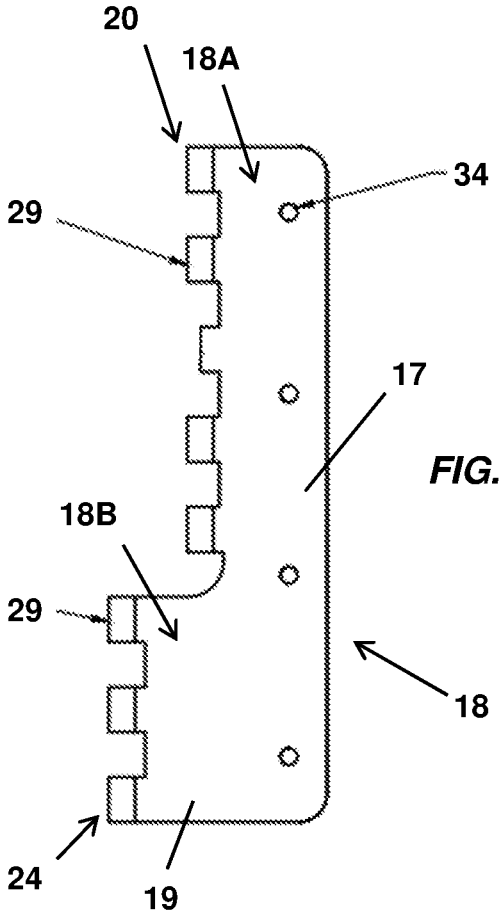
FIG. 15 is a back view of the fourth leaf.
Figure 16:
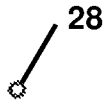
FIG. 16 is a top view of a pin for the hinge.
Figure 17:
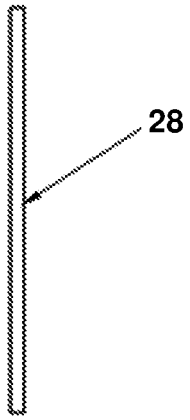
FIG. 17 is a side view of a pin for the hinge.
Figure 18:
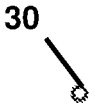
FIG. 18 is a top view of a second pin for the hinge.
Figure 19:
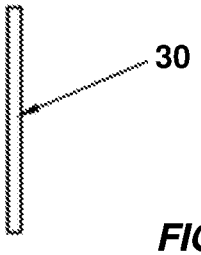
FIG. 19 is a side of the second pin for the hinge.

As illustrated in FIG. 14-15, a fourth leaf 18 has a tab or foot 19 extending outwardly from its length 17 such that the overall shape may be an "L" shape overall. This leaf 18 may have one or more apertures 34 therein for receiving a fastener for securing a frame or object for pivotal mounting to the hinge 10.

Referring to FIGS. 16-19, pins may be used to provide the pivoting action of each knuckle 20, 22, 24, and 26 for the various articulations provided by the hinge 10 and as the diameter of each knuckle 20, 22, 24, and 26 may be consistent, the height or length of the knuckles may vary based on the dimensions of the leaves being pivotally joined at the respective knuckle and thus pins of one or more lengths may be used for connecting the hollow circular part of the joint to form a knuckle or articulation point.

In one illustrative embodiment, hinge 10 is arranged such that a center of the articulation points 20 and 22, referred to as a lateral axis at the center of the respective pin for the knuckles 20 and 22, are spaced approximately 1.49 inches apart laterally. Measuring from approximately the center of articulation point 20 to the center of articulation point 24, these articulation points 20 and 24 are laterally spaced approximately 0.54 inches apart. Measuring from approximately the center of articulation point 22 to a center of articulation point 26, these articulation points 22 and 26 are laterally spaced approximately 5.54 inches apart.

Although the present disclosure has been described with reference to preferred embodiments, workers skilled in the art will recognize that changes may be made in form and detail without departing from the spirit and scope of the disclosure.

The invention claimed is:

1. A hinge comprising:

a plurality of leaves; and a plurality of articulation points, wherein each leaf is connected to two different articulation points such that each leaf is connected to two different leaves, wherein each leaf of the plurality of leaves has a different dimension, and wherein at least one leaf has a first length extending along a first axis and a second length extending along a second axis and wherein the first and second axis are substantially perpendicular to one another.

2. The hinge of claim 1 wherein each of the plurality of leaves are substantially flat.

3. The hinge of claim 1 wherein a first leaf is provided with one or more apertures for securing the hinge to a mounting surface.

4. The hinge of claim 3 wherein a second leaf is provided with one or more apertures for securing an object to the hinge to pivotally secure the object to the mounting surface.

5. The hinge of claim 1 wherein in a first position the hinge is substantially flat having a substantially consistent thickness of less than about 3/16 inch.

6. The hinge of claim 1 having four leaves and four articulation points.

7. The hinge of claim 1 wherein each articulation point is a joint between two leaves forming a knuckle.

8. The hinge of claim 1 wherein each of the plurality of articulation points is actuated concurrently.

9. A hinge for pivotally securing a frame substantially flush to a mounting surface, the hinge comprising a plurality of substantially flat leaves, each leaf having different dimensions and at least one leaf having a non-symmetrical shape, and a plurality of articulation points wherein each leaf is connected to two articulation points and movement of at least one leaf connected to each articulation point results in substantially simultaneous movement of a second leaf connected to each same articulation joint 1.

10. The hinge of claim 9 comprising four leaves and four articulation points wherein one leaf is mounted to the mounting surface and the three remaining leaves are pivoted concurrently with one leaf pivoting about two different articulation points concurrently.

11. The hinge of claim 9 for mounting a first side of the frame to the mounting surface such that the frame can be pivoted away from the mounting surface about the first side by way of opening a second opposing side of the frame.

12. The hinge of claim 9 wherein the hinge has four leaves and four articulation points and in a first position the hinge is a substantially flat hinge.

13. The hinge of claim 12 wherein in a second position the hinge has three sides to form an overall triangular shape.

14. The hinge of claim 13 wherein two leaves form one side of the hinge in the second position.

15. The hinge of claim 13 wherein in the second position a first side of the hinge is secured to the mounting surface and a second side of the hinge supports the frame.

16. The hinge of claim 1 wherein two leaves each have a first length extending along a first axis and a second length extending along a second axis and wherein the first and second axis are substantially perpendicular to one another and wherein the two leaves are not connected by a same articulation joint.

* * * * *